United States Patent [19]

Harrison et al.

[11] Patent Number: 4,871,715

[45] Date of Patent: Oct. 3, 1989

[54] PHTHALATE ESTERS IN RECEIVING LAYER FOR IMPROVED DYE DENSITY TRANSFER

[75] Inventors: Daniel J. Harrison, Rochester; Kin K. Lum, Webster, both of N.Y.

[73] Assignee: Eastman Kodak Co., Rochester, N.Y.

[21] Appl. No.: 214,363

[22] Filed: Jul. 1, 1988

[51] Int. Cl.[4] ..... B41M 5/035; B41M 5/26

[52] U.S. Cl. ..... 503/227; 8/471; 428/412; 428/480; 428/913; 428/914

[58] Field of Search ..... 8/471; 428/195, 412, 428/480, 913, 914; 503/227

[56] References Cited

U.S. PATENT DOCUMENTS

| | | | |
|---|---|---|---|
| 4,474,859 | 10/1984 | Oshima et al. | 428/211 |
| 4,657,831 | 4/1987 | Ambro et al. | 430/14 |
| 4,740,497 | 4/1988 | Harrison et al. | 503/227 |

FOREIGN PATENT DOCUMENTS

| | | | |
|---|---|---|---|
| 19138 | 1/1985 | Japan | 503/227 |

*Primary Examiner*—Bruce H. Hess
*Attorney, Agent, or Firm*—Harold E. Cole

[57] ABSTRACT

A dye-receiving element for thermal dye transfer comprising a support having thereon a polymeric dye image-receiving layer containing a phthalate ester having the following formula:

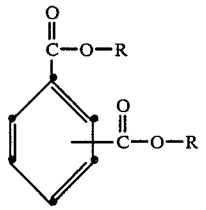

wherein R is a substituted or unsubstituted aryl group having from about 6 to about 10 carbon atoms or an aralkyl group having from about 7 to about 12 carbon atoms.

20 Claims, No Drawings

PHTHALATE ESTERS IN RECEIVING LAYER FOR IMPROVED DYE DENSITY TRANSFER

This invention relates to dye-receiving elements used in thermal dye transfer, and more particularly to the use of a phthalate ester in the dye-image-receiving layer to improve the dye density transfer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

U.S. Pat. No. 4,740,497 relates to the use of a mixture of poly(caprolactone) and a polycarbonate as the dye image-receiving layer in a thermal dye transfer element. Increasing the amount of poly(caprolactone) in the mixture was found to give increased dye transfer density. However, when the amount of poly(caprolactone) is increased above about 40%, the coatings become hazy, resulting in a loss of surface gloss in the final coated element and are subject to smearing. It would be desirable to provide a dye image-receiving layer which would have increased density without a loss of surface gloss and would not be being subject to smearing.

JP No. 60/19,138 relates to the use of an image-receiving layer comprising a polycarbonate and a plasticizer. The plasticizers disclosed are all phthalate acid alkyl-esters such as dibutyl phthalate. There is a problem with this compound, however, in that it does not retain its dye density boosting effect upon incubation, as will be shown by comparative tests hereinafter. It would be desirable to obtain a compound which would provide increased dye density upon transfer and which would not lose its effect upon keeping.

These and other objects are achieved in accordance with this invention which comprises a dye-receiving element for thermal dye transfer comprising a support having thereon a polymeric dye image-receiving layer, and wherein the dye image-receiving layer contains a phthalate ester having the following formula:

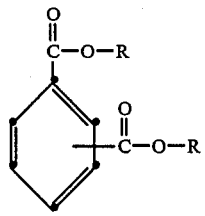

wherein R is a substitited or unsubstituted aryl group having from about 6 to about 10 carbon atoms or an aralkyl group having from about 7 to about 12 carbon atoms.

In the above formula, R may be, for example, phenyl, pyridyl, naphthyl, p-tolyl, p-chlorophenyl, m-(N-methyl sulfamoyl)phenyl, p-methoxyphenyl, benzyl, p-methoxybenzyl, p-chlorobenzyl, etc. In a preferred embodiment of the invention, the phthalate ester is diphenyl phthalate.

The phthalate ester may be present in the dye image-receiving layer in any amount which is effective for the intended purpose. In general, good results have been obtained when the phthalate ester is present in an amount of from about 10 to about 100% based on the weight of the material in the dye image-receiving layer.

The polymeric dye image-receiving layer of the dye-receiver of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 $g/m^2$.

In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis-(oxyphenyl)butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula

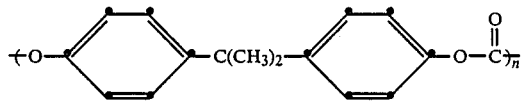

wherein n is from about 100 to about 500.

Examples of such polycarbonates include General Electric Lexan®Polycarbonate Resin #ML-4735 (Number average molecular weight app. 36,000), and Bayer AG Makrolon #5705® (Number average molecular weight app. 58,000). The later material has a $T_g$ of 150° C.

The support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyethylene-coated paper is employed. It may be employed at any thickness desired, usually from about 50 μm to about 1000 μm.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.) Sumickaron Diazo Black 5G® (Product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

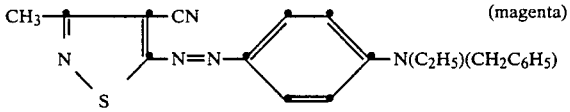

(magenta)

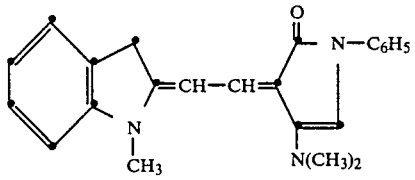

(yellow)

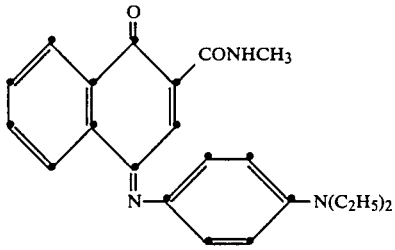

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyesters, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about .001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. application Ser. Nos. 059,442 of Byers and Chapman, filed June 8, 1987; 059,443 of Evans and Weber, filed June 8, 1987; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer,. the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

A dye-donor of alternating sequential areas of cyan, magenta and yellow dye was prepared by coating on a 6 μm poly(ethylene terephthalate) support:

(1) a subbing layer of a titanium alkoxide (duPont Tyzor TBT ®)(0.12 g/m$^2$) from a n-propyl acetate and n-butyl alcohol solvent mixture, and (2) a dye layer containing the cyan dye illustrated above (0.28 g/m$^2$), the magenta dye illustrated above (0.15 g/m$^2$) or the yellow dye illustrated above (0.14 g/m$^2$), and Micropowders, Inc. Fluo-HT ® micronized polytetrafluoroethylene(0.05 g/m$^2$), in a cellulose acetate propionate (2.5% acetyl, 45% propionyl) binder (0.25–0.32 g/m$^2$) coated from a toluene, methanol and cyclopentanone solvent mixture.

On the back side of the dye-donor was coated:

(1) a subbing layer of a titanium alkoxide (duPont Tyzor TBT ®)(0.12 g/m$^2$) from a n-propyl acetate and n-butyl alcohol solvent mixture, and (2) a slipping layer of Petrarch Systems PS513 ® amino-terminated polysiloxane (0.001 g/m$^2$); p-toluenesulfonic acid (2.5% of the wt. of the polysiloxane); Emralon 329 ® (Acheson Colloids Corp.) dry film lubricant of poly(tetrafluoroethylene) particles in a cellulose nitrate resin binder (0.54 g/m$^2$); and BYK-320 ® (BYK Chemie, USA) copolymer of a polyalkylene oxide and a methyl alkylsiloxane (0.002 g/m$^2$), coated from a n-propyl acetate, toluene, isopropyl alcohol and n-butyl alcohol solvent mixture.

A control dye-receiving element was prepared by coating the following layers in the order recited on a titanium dioxide-pigmented polyethylene-overcoated paper stock:

(1) Subbing layer of poly(acrylonitrileco-vinylidene chloride-co-acrylic acid) (14:79:7 wt. ratio) (0.08 g/m$^2$) coated from 2-butanone, and (2) Dye-receiving layer of Makrolon 5705 ® (Bayer AG Corporation) polycarbonate resin (2.9 g/m$^2$), FC-431 ® surfactant (3M Corp.) (0.016 g/m$^2$) and tone PCL-700 ® polycaprolactone (Union Carbide) in the amount stated in the Table, coated from methylene chloride.

Another control element was prepared similar to the one above except that it contained di-n-butyl phthalate (Kodak L&R Products) instead of the polycaprolactone.

A dye-receiving element according to the invention was prepared similar to the control elements except that instead of the polycaprolactone it contained diphenyl phthalate:

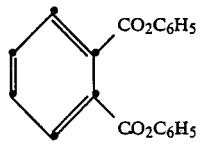

The dye side of the dye-donor element strip approximately 10 cm x 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor-receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot. Individual color stepped images were obtained by printing from the three dye-donors.

The amount of dye transferred into the receiver was calculated by measuring the % dye remaining in the dye-donor using a Status A transmission densitometer and substracting that % from 100. Surface gloss or lack thereof was visually estimated. The following results were obtained:

TABLE 1

| Receiving Layer Addendum (g/m2) | % Dye Transer | | | Surface |
|---|---|---|---|---|
| | Blue | Green | Red | Gloss |
| Poycaprolactone (0) | 42 | 32 | 35 | Yes |
| Polycaproactone (0.44) | 49 | 34 | 38 | Yes |
| Polycaprolactone (0.87) | 48 | 35 | 36 | Yes |
| Polcaprolactone (1.74) | 46 | 49 | 63 | Yes |
| Polycaprolactone (2.34)* | 70 | 55 | 56 | Hazy |
| Dibutyl phthalate (0.87) | 66 | 54 | 50 | Yes |
| Dibutyl phthalate (1.74) | 81 | 75 | 71 | Yes |
| Dibutyl phthalate (2.37) | 84 | 79 | 76 | Yes |
| Diphenyl phthalate (0.44) | 59 | 44 | 47 | Yes |
| Diphenyl phthalate (0.87) | 64 | 51 | 47 | Yes |
| Diphenyl phthalate (1.74) | 78 | 65 | 57 | Yes |
| Diphenyl phthalate (2.37) | 81 | 72 | 70 | Yes |

*Equiualent to 45% polycaprolactone and 55% polycarbonate

The above results show that both dibutyl phthalate and diphenyl phthalate are more effective in increasing dye transfer efficiency than polycaprolactone at a given level without affecting surface gloss.

In a similar experiment, the dibutyl phthalate lost its effectiveness when the dye-receiver was incubated.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having thereon a thermally-transferred dye image in a polymeric dye image-receiving layer, the improvement wherein said dye image-receiving layer contains a phthalate ester having the following formula:

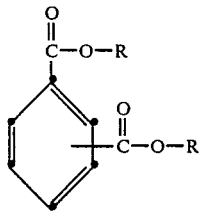

wherein R is a substituted or unsubstituted aryl group having from about 6 to about 10 carbon atoms or an aralkyl group having from about 7 to about 12 carbon atoms.

2. The element of claim 1 wherein R is phenyl.

3. The element of claim 1 wherein said ester is diphenyl phthalate.

4. The element of claim 1 wherein said phthalate is present in an amount of from about 10 to about 100% based on the weight of the dye image-receiving layer.

5. The element of claim 1 wherein said support is poly(ethylene terephthalate).

6. The element of claim 1 wherein said dye image-receiving layer is a bisphenol-A polycarbonate having a number average molecular weight of at least about 25,000.

7. The element of claim 6 wherein said bisphenol-A polycarbonate comprises recurring units having the formula

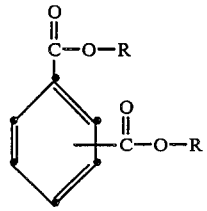

wherein n is from about 100 to about 500.

8. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, the improvement wherein said dye image-receiving layer contains a phthalate ester having the following formula:

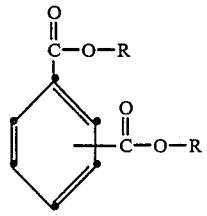

wherein R is a substituted or unsubstituted aryl group having from about 6 to about 10 carbon atoms or an aralkyl group having from about 7 to about 12 carbon atoms.

9. The process of claim 8 wherein R is phenyl.

10. The process of claim 8 wherein said ester is diphenyl phthalate.

11. The process of claim 8 wherein said phthalate is present in an amount of from about 10 to about 100% based on the weight of the dye image-receiving layer.

12. The process of claim 8 wherein said support is poly(ethylene terephthalate).

13. The process of claim 8 wherein said dye image-receiving layer is a bisphenol-A polycarbonate having a number average molecular weight of at least about 25,000.

14. The process of claim 13 wherein said bisphenol-A polycarbonate comprises recurring units having the formula

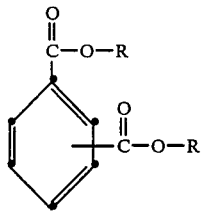

wherein n is from about 100 to about 500.

15. In a thermal dye transfer assemblage comprising:

(a) a dye-donor element comprising a support having thereon a dye layer, and (b) a dye-receiving element comprising a support having thereon a polymeric dye image-receiving layer, said dye-receiving element being in a superposed relationship with said dye-donor element so that said dye layer is in contact with said dye image-receiving layer, the improvement wherein said dye image-receiving layer contains a phthalate ester having the following formula:

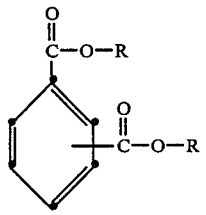

wherein R is a substituted or unsubstituted aryl group having from about 6 to about 10 carbon atoms or an aralkyl group having from about 7 to about 12 carbon atoms.

16. The assemblage of claim 15 wherein R is phenyl.

17. The assemblage of claim 15 wherein said ester is diphenyl phthalate.

18. The assemblage of claim 15 wherein said phthalate is present in an amount of from about 10 to about 100% based on the weight of the dye image-receiving layer.

19. The assemblage of claim 15 wherein said dye image-receiving layer is a bisphenol-A polycarbonate having a number average molecular weight of at least about 25,000.

20. The assemblage of claim 15 wherein said bisphenol-A polycarbonate comprises recurring units having the formula

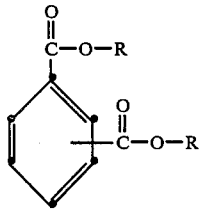

wherein n is from about 100 to about 500.

* * * * *